US006029040A

United States Patent [19]

Yamada et al.

[11] Patent Number: 6,029,040

[45] Date of Patent: Feb. 22, 2000

[54] FIXING APPARATUS AND RELEASING AGENT SUPPLYING APPARATUS

[75] Inventors: Takashi Yamada, Aichi-Ken; Satoru Yoneda, Toyohashi; Hideji Hayashi, Okazaki; Toshio Sakata, Toyohashi; Yoshifumi Kosagi, Toyokawa, all of Japan

[73] Assignee: Minolta Co., Ltd., Osaka, Japan

[21] Appl. No.: 09/179,938

[22] Filed: Oct. 28, 1998

[30] Foreign Application Priority Data

Oct. 29, 1997 [JP] Japan ..... 9-297171

[51] Int. Cl.[7] ..... G03G 15/20

[52] U.S. Cl. ..... 399/325; 492/17; 492/53

[58] Field of Search ..... 399/324, 325, 399/326; 492/53, 17, 18

[56] References Cited

U.S. PATENT DOCUMENTS 5,482,552 1/1996 Kikukawa et al. ..... 399/324
5,674,020 10/1997 Kimura et al. ..... 399/325
5,732,317 3/1998 Orchard, II et al. ..... 399/325
5,839,041 11/1998 Condello et al. ..... 399/325
5,853,832 12/1998 Ishikawa ..... 399/325

FOREIGN PATENT DOCUMENTS 06318001 11/1994 Japan .

*Primary Examiner*—Richard Moses
*Attorney, Agent, or Firm*—McDermott, Will & Emery

[57] ABSTRACT

A fixing apparatus includes a fixing belt that pressure-thermally fixes unfixed toner images on sheets, and an oil coating roller that holds silicone oil for preventing the offset phenomenon to be coated on the fixing belt. The oil coating roller consists of an inner oil holding layer formed of paper and a surface oil holding layer formed of aramid fibers. The oil diffusing capacity and the oil holding capacity are reduced from the inner oil holding layer toward the surface oil holding layer. Thus, it is possible to suppress the oil coating amount in the initial period of the roller life to a level that does not cause problems such as oil stains, increase the oil coating amount in the final period of the roller life to a level that does not cause problems such as offsets, and prevent image noises.

14 Claims, 5 Drawing Sheets

FIXING APPARATUS AND RELEASING AGENT SUPPLYING APPARATUS

BACKGROUND OF THE INVENTION

1. Field of the Invention

The present invention relates to a fixing apparatus provided in image forming apparatuses such as electrophotographic printers and copying machines, more specifically, a releasing agent supplying apparatus for preventing the offset phenomenon on rotating members used for pressure-thermal fixing of images, and a fixing apparatus equipped with such a releasing agent supplying apparatus.

2. Description of the Related Art

An image forming apparatus such as a printer and a copying machine using the electrophotographic process is typically equipped with a fixing apparatus for fixing unfixed images held on a sheet of paper as a recording medium. There are several kinds of fixing processes. The pressure-thermal fixing is one of the most popular processes. The fixing apparatuses based on the pressure-thermal fixing process can be divided into the belt type and the thermal roller type. For example, a belt type fixing apparatus was disclosed by JP-A-6-318001.

In the fixing apparatus based on the pressure-thermal fixing process, a surface of the sheet that holds the toner makes a direct contact with the outer surface of a rotating member such as a fixing belt or a fixing roller. As a result, a portion of the unfixed toner image can readily be transferred to the rotating member.

Consequently, it causes the offset phenomenon or the problem that the toner adhered to the rotating member can be transferred again to the trailing edge of the sheet to smear said sheet or the next sheet to be sent in, thus smearing said sheet. Therefore, a device has been introduced to coat (supply) the rotating member with a releasing agent that improves the characteristic of releasing the toner from the rotating member. Silicone oil (hereinafter called simply "the oil") is commonly used as the releasing agent.

The conventional oil coating apparatus (releasing agent supplying apparatus) typically has an oil coating roller that coats the rotating member with the oil held therein. Such an oil coating roller typically has a cylinder the outer periphery of which is provided with a plurality of small holes and a porous elastic layer such as a sponge layer that covers the outer periphery of the cylinder to contact with the rotating member under pressure. The oil coating roller is driven by the rotating member and supplies the oil held inside the cylinder through the porous elastic layer to the outer periphery of the rotating member.

In the conventional constitution, the amount of oil coated per sheet does not remain constant from the start of the uses of an oil coating roller until it is used up and the roller is replaced with a new roller, but rather it is delivered more in the early period of the life of the roller and reduces with time towards the end. As a result, towards the end of the oil coating roller's life, the offset phenomenon is likely to occur because the amount of oil coated per sheet is not enough. On the other hand, if the lower limit of the oil coating amount is simply raised in order to prevent the offset in the later stage of the oil coating roller's life, the oil coating amount in the early period becomes too much and may cause oil stains and image noises such as whiting of the image. In order to resolve this problem, it is conceivable to provide a blade to wipe out excessive oil on the rotating member in such a way as to be able to contact under pressure or to back away at will. However, such a provision of a movable blade makes the structure of the fixing apparatus more complicated and requires a complex blade motion control.

In the belt type fixing apparatus disclosed by JP-A-6-318001, the sheet holding the unfixed toner is transferred in such a way as to face against the fixing belt. Therefore, the unfixed toner on the sheet is preheated to a certain degree by the radiant heat from the fixing belt before the fixing belt and the pressure roller arrive at the nip area where they contact each other under pressure. Thus, in case of the belt type fixing apparatus, the temperature of the fixing belt at the nip area can be set lower than in the case of the roller fixing type, making it possible to set the amount of oil coated to about one tenth of that of the roller type fixing apparatus.

In order to take advantage of the belt type fixing apparatus, it is desired to develop the oil coating roller that is capable of coating a smaller amount of oil (e.g., 0.1–10 mg per A4 size sheet) in a stable manner throughout the entire roller life span, from the start to finish.

SUMMARY OF THE INVENTION

One purpose of the invention is to suppress the amount of coated releasing agent (amount of supplied releasing agent) at the initial period of the roller life to a level that does not cause problems such as oil stains, as well as to increase the amount of coated releasing agent (amount of supplied releasing agent) at the terminal period of the roller life to a level that does not cause problems such as the offset phenomenon, so as to prevent image noises throughout the entire life span of the roller.

One aspect of the present invention is a releasing agent supplying apparatus for supplying releasing agent to a fixing device, the apparatus comprising: a shaft, a first releasing agent holding layer provided around the shaft, and a second releasing agent holding layer provided outside of the first releasing agent holding layer, releasing agent holding capacity of the second releasing agent layer is less than that of the first releasing agent holding layer.

Another aspect of the present invention is a releasing agent supplying apparatus for supplying releasing agent to a fixing device, the apparatus comprising: a shaft, and a releasing agent holding layer provided around the shaft, the releasing agent holding layer has a region with a small releasing agent holding capacity in a direction extending from the shaft toward an outer surface of the releasing agent holding layer.

Another aspect of the present invention is a fixing device that contacts toner on a recording medium; a pressuring device that fixes the toner by pressing the fixing device on the toner; a supplying device that supplies releasing agent on a surface of the fixing device; and a releasing agent supplying apparatus for supplying the releasing agent to the supplying device, comprising a shaft, a first releasing agent holding layer provided around the shaft and a second releasing agent holding layer outside of the first releasing agent holding layer, releasing agent holding capacity of the second releasing agent layer being less than that of the first releasing agent holding layer.

Another aspect of the present invention is a fixing apparatus comprising: a fixing device that contacts toner on a recording medium; a pressuring device that fixes the toner by pressing the fixing device on the toner; a supplying device that supplies releasing agent on a surface of the fixing device; and a releasing agent supplying apparatus for supplying the releasing agent to the supplying device, comprising a shaft and a releasing agent holding layer provided around the shaft, the releasing agent holding layer having a region with a small releasing agent holding capacity in a direction extending from the shaft toward an outer surface of the releasing agent holding layer.

The objects, features, and characteristics of this invention other than those set forth above will become apparent from the description given herein below with reference to preferred embodiments illustrated in the accompanying drawings.

DETAILED DESCRIPTION OF THE PREFERRED EMBODIMENT

The embodiments of this invention will be described below with reference to the accompanying drawings.

Figure 1:
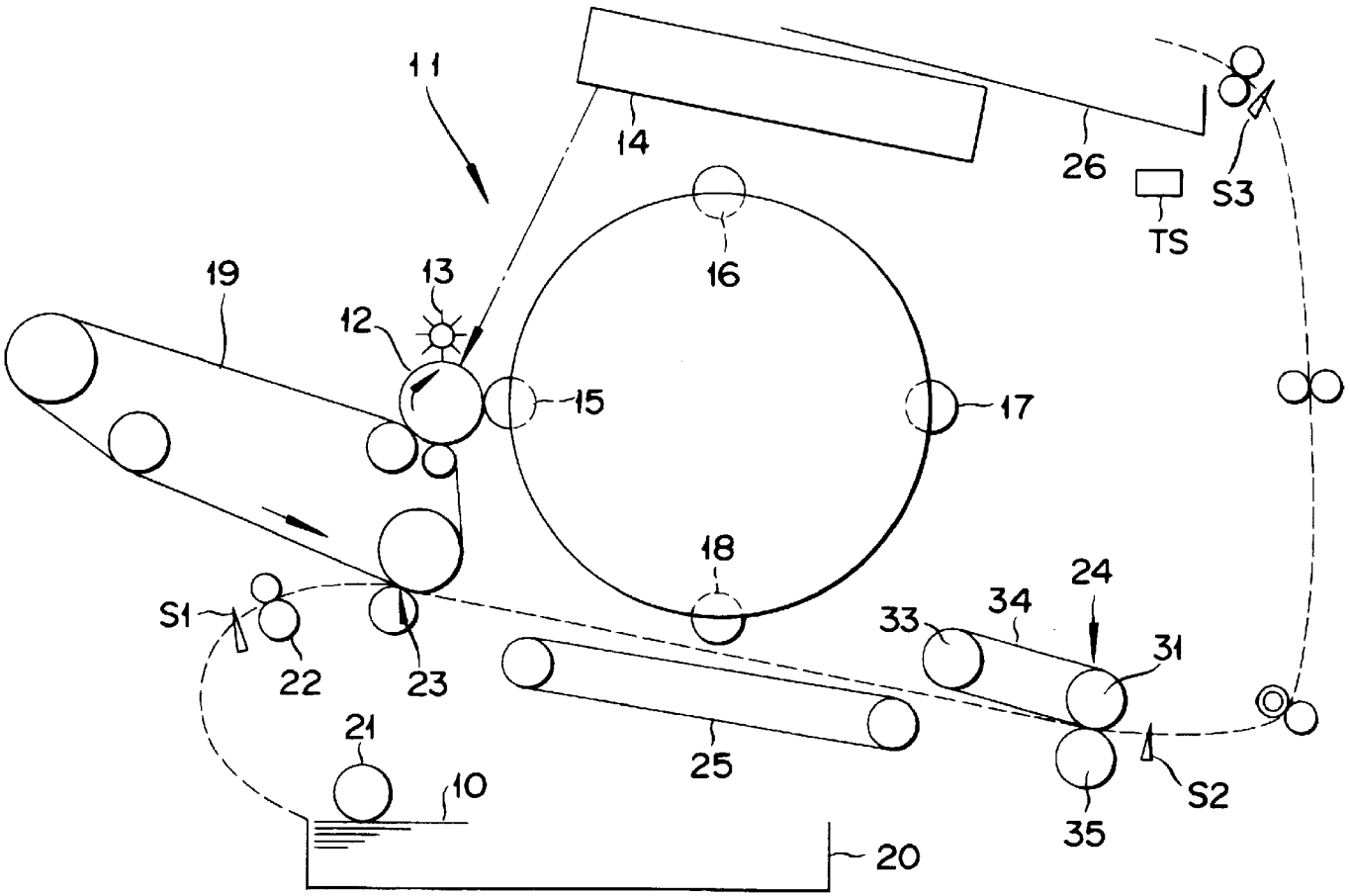
FIG. 1 is a schematic drawing of an electrophotographic full-color printer equipped with a built-in fixing apparatus according to the present invention.

FIG. 1 is a schematic drawing of an electrophotographic full-color printer equipped with a built-in fixing apparatus according to the present invention.

A printer 11 shown in FIG. 1 comprises a photoconductor drum 12, which functions as an image carrier, and a laser generator 14. The photoconductor drum 12 that rotates in the direction indicated by the arrow is surrounded by an electrostatic charger 13 that charges the outer periphery of the photoconductor drum 12, a developing device equipped with the first through fourth developing units 15, 16, 17, and 18, a transfer belt 19, a cleaning device (not shown) that removes remaining toner on the photoconductor drum 12, and an internal temperature sensor TS that detects the internal temperature of the printer 11.

The laser generator 14 generates and modulates laser beams depending on the level of the image signal sent from equipment such as a computer (not shown). The laser beams pass through a polygon mirror, an f-θ lens, a reversing mirror, etc., which are not shown in the figure, to irradiate the photoconductor drum 12 between the electrostatic charger 13 and the developing device.

An electrostatic latent image formed on the photoconductor drum 12 in response to the laser beams becomes an apparent image as a yellow toner image by means of the first developing unit 15. The yellow image thus formed is then held on the transfer belt 19 that moves in a rotating manner in the direction indicated by the arrow. The following electrostatic latent image formed on the photoconductor drum 12 becomes apparent as a magenta toner image by means of the second developing unit 16. This magenta image is overlaid on the yellow toner image on the transfer belt 19. Similarly, the succeeding electrostatic latent image formed on the photoconductor drum 12 becomes apparent as a cyan toner image by means of the third developing unit 17. When this cyan toner image is overlaid on the existing image on the transfer belt 19, a full-color image will be generated. The fourth developing unit 18 holds a black toner. When a monochromatic print is designated, the electrostatic latent image on the photoconductor drum 12 becomes an apparent image by the fourth developing unit 18.

A paper feed cassette 20 detachably attached to the printer main unit has a plurality sheets of paper 10 in an accumulated condition. The sheets 10 are fed one sheet at a time with a help of a paper feed roller 21 and transported by means of a timing roller 22 timed with the toner formation to a transfer zone 23. The full-color toner image on the transfer belt 19 is transferred to the sheet 10 in this transfer zone 23. After the transfer, the sheet 10 is separated from the transfer belt 19 and transported toward a fixing apparatus 24 by means of a transporting belt 25. The unfixed toner transferred to the sheet 10 is fused and fixed at the fixing apparatus 24. The sheet on which the toner is fixed is discharged to a discharge tray 26. This fixing apparatus 24 is a belt type apparatus, the constitution of which will be described later.

Once the transfer to the sheet 10 is completed, the remaining toner on the photoconductor drum 12 is removed by the cleaning device and remaining electrostatic charge is eliminated by an electrostatic eraser. The photoconductor drum 12 is then recharged by the electrostatic charger 13, and on which a latent image is formed by laser beams and developed by the developing units 15 through 18.

Along the sheet transport path, a plurality of sensors S1, S2 and S3 are arranged to detect the sheet 10. These sensors S1, S2 and S3 output signals as they detect the leading edge and/or the trailing edge of the sheet 10 to provide control timing for members disposed inside the printer.

Figure 2:
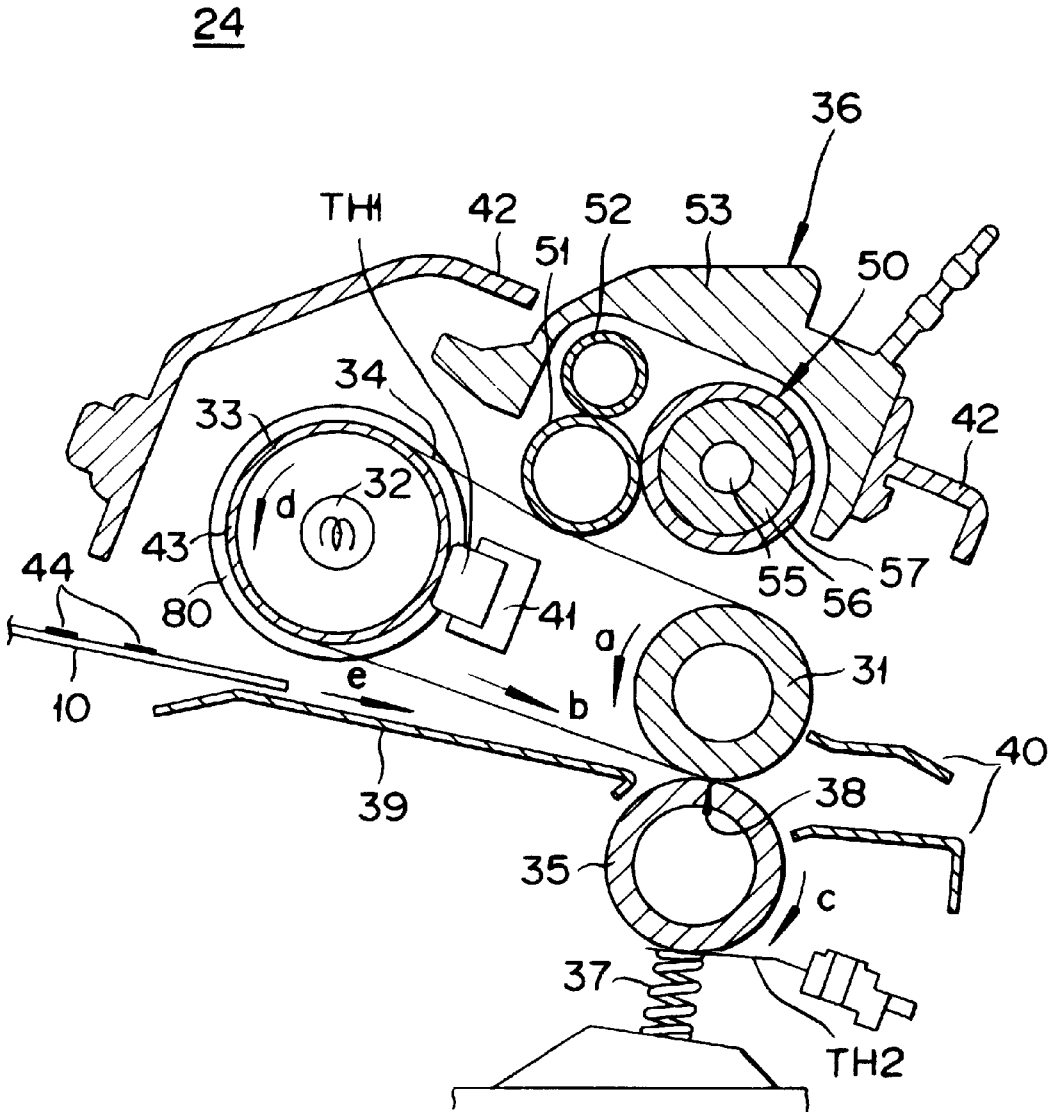
FIG. 2 is a sectional view of the belt-type fixing apparatus shown in FIG. 1.

FIG. 2 is the cross section of the belt type fixing apparatus shown in FIG. 1.

The fixing apparatus 24 comprises: a driving roller 31 that is arranged to be able to rotate in the direction of the arrow a; a heat roller 33 that has a heat source such as a built-in halogen heater lamp 32; a fixing belt 34 that runs between the driving roller 31 and the heat roller 33; a pressure roller 35 that applies pressure to the driving roller 31 via the fixing belt 34; and an oil coating apparatus (releasing agent supplying apparatus) 36 that coats (supplies) a releasing agent on the outer periphery of the fixing belt 34 in order to prevent the offset phenomenon.

At least one of the rollers 31 and 33 between which the fixing belt 34 runs (the heat roller 33 in the example depicted in the figure), is equipped at both ends as to the axial direction with an edge regulator 80 that prevents the fixing belt 34 from making slant or snaking motions when the belt is running in order to stabilize the running of the fixing belt 34. The fixing belt 34 functions as the rotating member for pressure-thermal fixation of the toner held on the sheet 10. The releasing agent used here is silicone oil.

The fixing belt 34 has a thin thickness and is preferably a seamless belt. The fixing belt 34 shown in FIG. 2 is an endless belt comprising: a belt base consisting of either carbon steel, stainless steel, nickel or heat-resistant resin; and a rubber layer with good heat-resisting properties and release properties against the toner formed by coating the outer surface of the belt base with silicon rubber having a good affinity with silicone oil. The thickness of the belt base is approximately 40 $\mu$m. The thickness of the rubber layer is approximately 200 $\mu$m. The rubber layer of the fixing belt 34 can be formed with tetrafluoroethylene resin.

The driving roller 31 has a drive gear (not shown) affixed to one end thereof, the drive gear being driven by a drive source (not shown) such as an electric motor in the direction indicated by the arrow a. The driving roller 31 comes in contact with the backside of the fixing belt 34 to drive the fixing belt 34 toward the direction indicated by the arrow b. In order to move the fixing belt 34 securely, the outer periphery of the driving roller 31 is covered by a material with a high friction coefficient such as silicon rubber so that it does not slip relative to the fixing belt 34. Moreover, in order to secure a prescribed nipping width, the material that covers the outer periphery of the driving roller 31 is preferably a material with a relatively small hardness, for example, silicon sponge.

The heat roller 33 is a hollow metal roller having the halogen heater lamp 32 installed on the axis thereof. The heat source of the halogen heater lamp 32 is a resistance heating element or an electromagnetic induction heating device. Also, from the standpoint of providing heat effectively to the fixing belt 34, the heat roller 33 is preferably made of a material with a high thermal conductivity, such as aluminum or copper.

The pressure roller 35 is a roller made of a metal pipe, the outer periphery of which is covered with silicon rubber or tetrafluoroethylene resin, and is urged by the spring force of a spring 37 to press against the driving roller 31 via the fixing belt 34. As the fixing belt 34 moves in the direction of arrow b in correspondence with the rotation of the driving roller 31, the pressure roller 35 is driven in the direction of the arrow c due to its friction with the fixing belt 34. The outer surface hardness of the driving roller 31 and that of the pressure roller 35 are set to hold a relation: "outer surface hardness of the pressure roller 35≧outer surface hardness of the driving roller 31."

The reason for this setting is as follows. In order to smoothly discharge the sheet 10 after the toner is fixed from a nip area 38 between the pressure roller 35 and the fixing belt 34, it is necessary to transport the sheet 10 in the direction tangentially from the surface of the driving roller 31, i.e., flatly. This can be achieved if the pressure roller 35 sinks into the driving roller 31 slightly via the fixing belt 34.

In order to guide the sheet 10 holding the unfixed toner to the nip area 38 without it touching the fixing belt 34, a guide plate 39 is provided under the fixing belt 34. Also, a paper discharge guide 40 is provided in the downstream of the nip area 38.

A first temperature sensor TH1 is provided inside of the fixing belt 34 to detect the temperature of the heat roller 33. A second temperature sensor TH2 is provided next to the pressure roller 35 to detect the temperature of the pressure roller 35. The first and second temperature sensors TH1 and TH2 are consisting of thermistors and contact the outer surfaces of the heat roller 33 and the pressure roller 35 respectively to detect their surface temperatures. The first temperature sensor TH1 is supported by a support 41 positioned relative to the rotating axis of the heat roller 33 to maintain a fixed position relative to the rotating axis of the heat roller 33, i.e., a contacting condition.

The printer 11 detects an outer surface temperature of the pressure roller 35, which is not equipped with a heating source, by means of the second temperature sensor TH2 and determines a control temperature of the halogen heater lamp 32 as well as the print start timing based on the outer surface temperature of the pressure roller 35 thus detected.

The halogen heater lamp 32 is controlled by turning the current on and off depending on the outer temperature of the heat roller 33 detected by the first temperature sensor TH1 and is adjusted to the determined control temperature. As a safety mechanism against abnormally high temperatures of the halogen heater lamp 32, a thermostat may be provided on the support 41, so that the power supply to the halogen heater lamp 32 can be shut off when the temperature becomes abnormally high.

As an alternative configuration, the first temperature sensor TH1 can be provided to contact the point on the outer surface of the fixing belt 34 where the heat roller 33 is contacting. Under such a configuration, the temperature of the outer surface of the fixing belt 34 is directly measured, the temperature control becomes more accurate. On the other hand, it may cause problems such as damages on the outer surface of the fixing belt 34 due to scraping actions caused by its physical contacts with the first temperature sensor TH1, resulting in deterioration of image quality due to image noises such as oil streaks or of the life-time of the belt.

In the present embodiment, the first temperature sensor TH1 is configured in such a way that it contacts the heat roller 33. Because of this configuration, the outer periphery of the heat roller 33 is covered by a material with a low friction coefficient such as fluorocarbon resin. There is an additional advantage in placing the first temperature sensor TH1 inside the fixing belt 34 in that it is not affected by the air stream generated around the fixing belt 34.

The oil coating apparatus 36 is placed above the fixing belt 34 and comprises: an oil coating roller 50 that holds the oil to be coated on the fixing belt 34; an oil transfer roller 51 that abuts against the outer surface of the oil coating roller 50 and coats the oil supplied by the oil coating roller 50 on the outer surface of the fixing belt 34; a cleaning roller 52 that abuts against the outer surface of the oil transfer roller 51 to remove paper powder and the toner adhering on the oil transfer roller 51; and a holder 53 that supports these roller 50, 51, and 52 in such a manner as to let them rotate freely.

The oil transfer roller 51 provides an appropriate tension to the fixing belt 34 by pressuring the fixing belt 34 in the area where the fixing belt 34 moves from the driving roller 31 to the heat roller 33. This stabilizes the running of the fixing belt 34 as well as the oil coating action of the oil transfer roller 51 onto the fixing belt 34.

The oil coating roller 50 has a double layer construction consisting of an inner oil holding layer 56 surrounding a core bar 55, and a surface oil holding layer 57 provided on top of the inner oil holding layer 56. The oil transfer roller 51 is constituted of a silicon rubber with a good affinity with the silicone oil covering the core bar. The cleaning roller 52 comprises a core bar and a material such as felt covering the core bar.

The surface roughness of the outer surface of the oil transfer roller 51 is chosen to be rougher than that of the outer surface of the fixing belt 34 in order to attract soil from the fixing belt 34. The release properties of the outer surface of the cleaning roller 52 is chosen to be lower than the outer surface of the oil transfer roller 51 in order to attract soil from the oil transfer roller 51.

The oil coating apparatus 36 is constituted in such a way as to be detachable from the frame 42 of the fixing device 24. When the oil held inside the oil coating roller 50 is used up, the oil coating apparatus 36 is removed and replaced with a new oil coating apparatus 36 to be attached to the frame 42. The cleaning pad, instead of cleaning roller 52, can be used to contact the outer surface of the oil transfer roller 51. The oil coating roller 50 can be pressed against the fixing belt 34 directly.

The outline of the operation of the fixing device 24 is as follows.

When the motor is activated, the driving roller 31 rotates in the direction the arrow a and the fixing belt 34 runs in the direction of the arrow b. As the fixing belt 34 runs, the heat roller 33 is driven in the direction of the arrow d, and the pressure roller 35 is driven in the direction of the arrow c. The fixing belt 34 gets coated with the oil as it runs on the up-stream side of the heat roller 33 and heated to a prescribed temperature by the heat from the halogen heater lamp 32 at the region (heating region 43) of contact with the heat roller 33, moving above the guide plate 39 toward the nip area 38 between the pressure roller 35 and the fixing belt 34.

The sheet 10 that holds the unfixed toner 44 on the side contacting the fixing belt 34 is transported in the direction of the arrow e toward the nip area 38 guided by the guide plate 39. At this time, the sheet 10 and the unfixed toner 44 are heated (preheated) by the heat from the fixing belt 34 facing them separated by a prescribed distance. Due to this heating, the unfixed toner 44 on the sheet 10 becomes softened to an appropriate degree.

When the sheet 10 arrives at the nip area 38, it is heated well by the heat from the contacting fixing belt 34, is pressed between the pressure roller 35 and the driving roller 31, and is further transported as it is nipped at the nip area 38. Thus, the unfixed toner 44 on the sheet 10 is sufficiently heated to fuse and fixed on the sheet 10 as it is pressured. The transfer of the toner to the fixing belt 34 is inhibited by the oil coated on the outer surface of the fixing belt 34. The sheet 10 that has passed through the nip area 38, separates spontaneously from the fixing belt 34, and transported toward the paper discharge tray 26 (refer to FIG. 1). The fixing belt 34, having been removed of heat due to the contact with the sheet 10, is replenished with the heat from the halogen heater lamp 32 under the temperature control.

Since the heating of the fixing belt 34 is done after coating with the oil, the temperature of the fixing belt 34 is stable and a good fixation can be expected. Also, since the oil transfer roller 51 applies a tension to the fixing belt 34, unevenness (wild motion) in the running of the fixing belt 34 can be minimized. Consequently, together with the help of the edge regulator 80, it provides the fixing belt 34 a smooth and stable running motion, thus contributing to the prolonging of the belt life.

Since the soiling of the fixing belt 34 due to paper dust, toner, etc., can be transferred to the cleaning roller 52 via the oil transfer roller 51 in contact with the fixing belt 34, so that the transfer of the soil to the oil coating roller 50 can be reduced. This results in a more stable and uniform supply of the oil from the oil coating roller 50 to the oil transfer roller 51. This, in return, results in a more stable and uniform supply of the oil transfer roller 51 to the fixing belt 34. As a result, a high grade fixed images can be obtained while preventing the offset phenomenon and cleaning the fixing belt 34.

Figure 3:
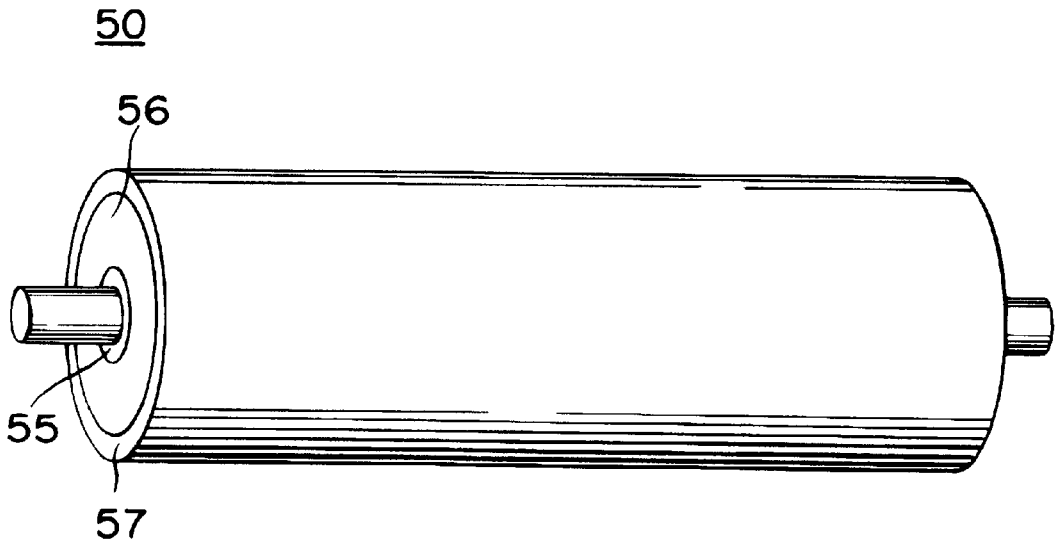
FIG. 3 is a perspective view of an oil coating roller.
Figure 4:
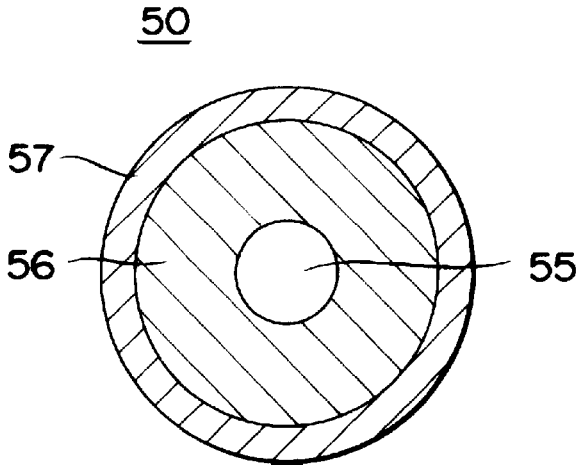
FIG. 4 is a sectional view of an oil coating roller.

Next, let us describe the constitution of the oil coating roller 50 in details. FIG. 3 is a perspective view of the oil coating roller 50. FIG. 4 is a cross section of the oil coating roller 50.

As shown in the figure, the oil coating roller 50 has a double layer construction consisting of the inner oil holding layer 56 surrounding the core bar 55, and the surface oil holding layer 57 provided on top of the inner oil holding layer 56. The core bar 55 is, for example, a roller made of aluminum with an outside diameter of 10 mm. The inner oil holding layer 56 is formed by Japanese paper wrapped around the core bar 55 to a thickness of 5 mm. The surface oil holding layer 57 is formed by wrapping aromatic aramid fibers to a thickness of 0.2 mm around the inner oil holding layer 56.

The oil coating roller 50 is manufactured as follows. First, an edge of a sheet of Japanese paper is taped to the outside surface of the core bar 55 using a double-sided adhesive tape, etc., and wound around it until it reaches a prescribed thickness. This completes the formation of the inner oil holding layer 56. Next, an edge of a sheet of the aromatic aramid fibers is fixed on the outer surface of the inner oil holding layer 56 using such means as adhesives until a layer of a prescribed thickness is formed around the oil holding layer 56. This completes the formation of the surface oil holding layer 57. The oil coating roller 50 is then totally immersed into the coating oil filled into an oil tank, and is left there for a prescribed time. The oil will infiltrate into the inner oil holding layer 56 from the surface oil holding layer 57 as the time goes and eventually reaches an equilibrium state. This completes the manufacture of the oil coating roller 50.

In the manufacture of the oil coating roller 50, the materials for forming the inner oil holding layer 56 and the surface oil holding layer 57 are selected in such a way that both the "oil diffusing capacity (releasing agent diffusing capacity)" and the "oil holding capacity (releasing agent holding capacity)" of the inner oil holding layer 56 and the surface oil holding layer 57 will be less than that of the inner oil holding layer 56. The "oil diffusing capacity" is herein defined as the diffusion velocity of the oil (releasing agent) per unit time in the specimen, while the "oil holding capacity" is defined as the weight of the oil (weight of the releasing agent) that can be held in a unit volume of the specimen. The measuring method for the oil holding and diffusing capacities are to be described in the following.

Figure 5A:
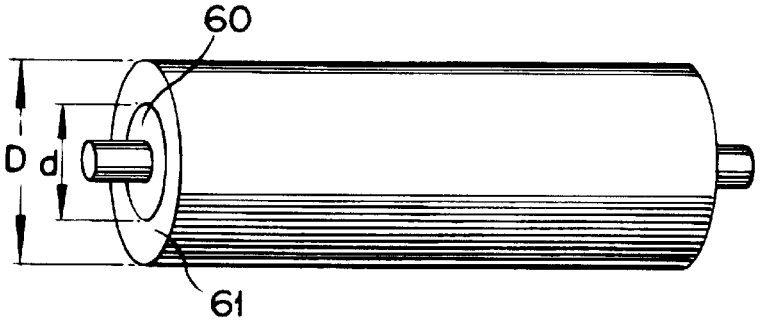
FIG. 5A through FIG. 5C are the drawings used for describing the method of measuring the oil holding capacity.
Figure 5B:
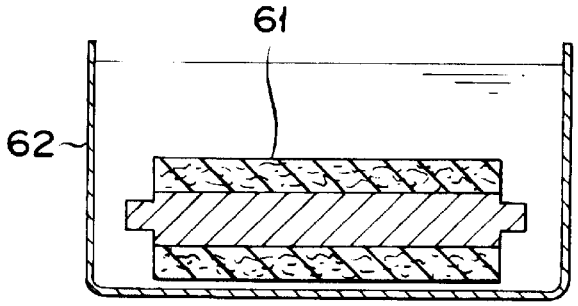
Figure 5C:
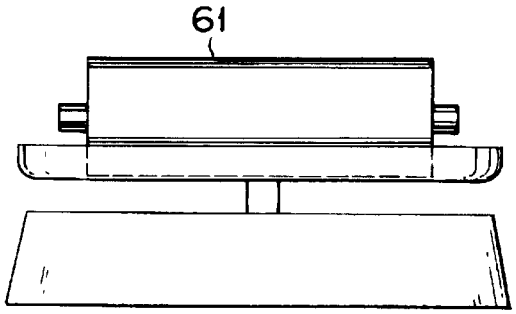

FIG. 5A through FIG. 5C are the drawings used for describing the method of measuring the oil holding capacity.

As shown in FIG. 5A, a specimen 61 is wound around the core bar 60 with an outer diameter d of 10 mm until a 3 mm thick layer is formed, or the outer diameter D grows to 16 mm. The axial length of the specimen 61 must be the prescribed length. When the winding is completed, the initial weight is measured as indicated in FIG. 5C. Next, as shown in FIG. 5B, the core bar 60 wrapped with the specimen 61 is totally immersed into the releasing agent filled in an oil tank 62. This releasing agent is a silicone oil having a viscosity of 100 cSt. After a sufficient time has passed to make the specimen 61 thoroughly infiltrated with the oil and reach the equilibrium condition, the core bar 60 with the winding of the specimen 61 is pulled up from the oil tank 62 to have its weight measured again as shown in FIG. 5C. The weight difference before and after the immersion is calculated and divided by the volume of the specimen 61 to provide the oil holding capacity.

Figure 6:
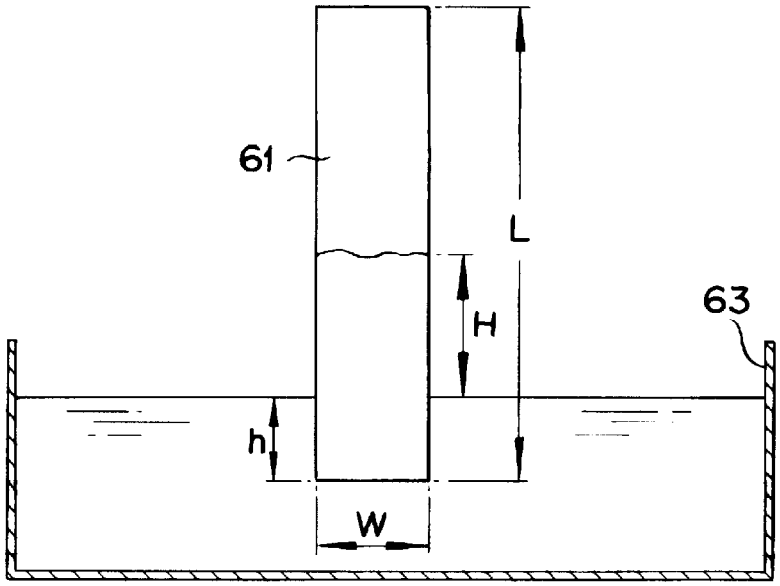
FIG. 6 is a drawing used for describing the oil diffusing capacity.

FIG. 6 is the drawing for describing the method of measuring the oil diffusing capacity.

The specimen 61 has the width W of 10 mm and the length L of 300 mm, and is immersed vertically into the releasing agent filling the oil tank 63. The immersion depth h is 23 mm. The releasing agent is a silicone oil with a viscosity of 100 cSt. The oil diffusing capacity is defined by the height H of oil sucked up after one hour since the immersion started.

The oil holding capacities of various specimens 61 are shown in the table 1 as follows.

TABLE 1

| Materials | Oil holding capacity [g/cm$^3$] | Oil diffusing capacity [mm/hr] | Heat resistant temperature [° C.] | Metsuke (grammage) [g/cm$^2$] | Thickness [mm] |
|---|---|---|---|---|---|
| Aromatic aramid fibers (1) | 0.3 | 35/28 | 200 | 60 | 0.096 |
| Aromatic aramid fibers (2) | 0.45 | 9/8 | 230 | 39 | 0.13 |
| Rock wool + Aramid fibers | 0.6 | 28/23 | 230 | 90 | 0.21 |
| Glass fibers + Aramid fibers | 0.63 | 16/16 | 230 | 55 | 0.21 |
| Japanese paper (1) | 0.5 | 35/28 | 150 | 64 | 0.17 |
| Japanese paper (2) | 0.2–0.3 | 7/7 | 150 | 81.4 | 0.1 |
| Japanese paper (3) | 0.57 | 35/31 | 150 | 64 | 0.19 |
| Polyester felt | 0.7–0.8 | | 180 | 290 | 1.0 |

The table 1 shows the heat resistant temperature of the specimen 61, Metsuke or grammage, and the thickness. The metsuke or grammage is defined by the weight per unit area. The quantities on the left side and the right side of the slush of each cell in the oil diffusing capacity column of the table 1 represent the capacities of the specimen 61 measured when the fibers of the specimen 61 are arranged vertically and the same measured when the fibers are arranged horizontally respectively. The oil diffusing capacity is mainly determined by the density of the specimen 61 and the viscosity of the releasing agent.

The larger the oil holding capacity of the specimen 61, the more oil it can hold internally. The higher the oil diffusing capacity of the specimen 61, the faster the oil can diffuse or be transported in its inside, thus causing more oil to be transported per unit time.

If the combination of the materials used to form the inner oil holding layer and the surface oil holding layer is selected in such a way that the oil diffusing capacity and the oil holding capacity of the surface oil holding layer are larger than those of the inner oil holding layer, the surface oil holding layer will be able to hold more oil. When the oil coating roller with such a constitution is used for the fixing device 24, there is a possibility of causing image noises such as oil stains and whiting of images due to the fact that an excessive amount of oil is coated on the fixing belt 34 in the initial period of the roller life.

In the final stage of the roller life, the amount of oil remaining in the inner oil holding layer becomes substantially lower, so that the amount of oil consumed at the surface oil layer tends to exceed the amount of oil being supplied from the inner oil holding layer to the surface oil holding layer, thus creating a situation where the offset phenomenon can occur abruptly. Moreover, the oil coating amount generally increases. As a result, the advantage of the belt type fixing apparatus that its oil consumption is as small as one tenth of the roller type fixing apparatus due to the effect of preheating becomes no longer valid and the roller life is shortened.

On the other hand, the oil coating roller 50 of the present embodiment has such a combination of materials that are used to form the inner oil holding layer 56 and the surface oil holding layer 57 is selected in such a way that the oil diffusing capacity and the oil holding capacity of the surface oil holding layer 57 are smaller than those of the inner oil holding layer 56. More specifically, the inner oil holding layer 56 is formed using Japanese paper (3)and the surface oil holding layer 57 is formed using aromatic aramid fibers (2) as indicated in the table 1. Aromatic amid fibers (2) have better heat-resistance and smoothness than Japanese paper (3).

The oil coating roller 50 constituted in such a way allows more oil to be held in side the inner oil holding layer 56, and gradually supplies oil in the surface oil holding layer 57. As a result, the fixing belt 34 does not get an excessive amount of the oil, and no image noises such as oil stains occur in the early period of the roller life. Also, in the final period of the roller life, even if the amount of oil remaining in the inner oil holding layer 56 becomes substantially lower, the amount of oil consumed at the surface oil holding layer 57 is unlikely to exceed the amount of oil being supplied from the inner oil holding layer 56 to the surface oil holding layer 56, thus a chance of causing the offset phenomenon abruptly is kept minimum.

Moreover, the embodiment provides a stable, small amount of coating of the oil (0.1–10 mg per A4 size sheet). Therefore, the advantage of the belt type fixing apparatus which requires only a small amount of coating of the oil can be fully appreciated with this embodiment and the embodiment contributes in prolonging the roller's life. The fixing apparatus 24 equipped with this oil coating roller 50 can prevent the occurrence of image noises for a long time.

It was learned through experiments that, in order to obtain a stable, small amount of coating of the oil, the oil holding capacity of the surface oil holding layer 57 is preferably in the range of 0.3–0.7 [g/cm$^3$] and the oil diffusing capacity of the inner oil holding layer 56 is higher than 17 [mm/hr]. It was also learned that, in order to prolong the roller's life, the oil holding capacity of the inner oil holding layer 56 is larger than the oil holding capacity of the surface oil holding layer 57 and is in the range of 0.3–0.7 [g/cm$^3$] at the same time.

Figure 7A:
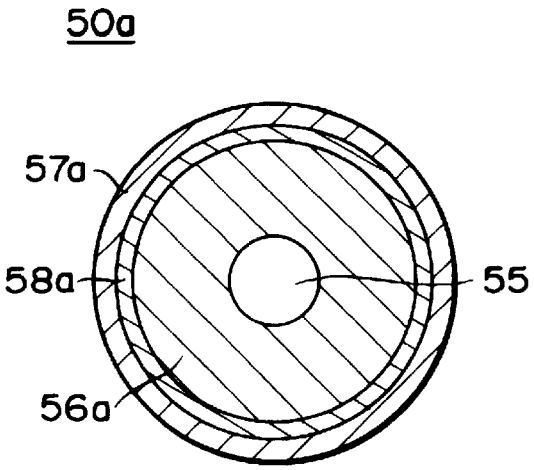
FIGS. 7A and 7B are sectional views of the oil coating roller of other embodiments respectively.
Figure 7B:
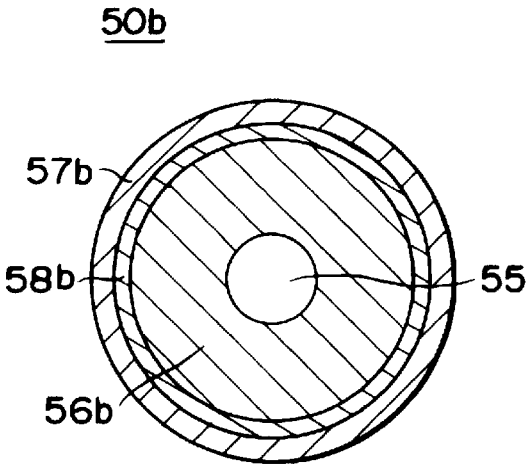

FIGS. 7A and 7B are cross sections of the oil coating roller of other embodiments respectively.

The oil coating roller 50 described in the above has a double layer structure. However, the present invention is not limited to such a constitution, but rather can be applied to a multi-layer structure containing at least the inner oil holding layer and the surface oil holding layer.

For example, as shown in FIGS. 7A and 7B, oil coating rollers 50*a* and 50*b* have constitutions where three layers are provided on the outside of the core bar 55, three layers comprising, inner oil holding layer 56*a* and 56*b*, adjusting layers 58*a* and 58*b* provided on the outside of the inner oil holding layer 56*a* and 56*b*, and surface oil holding layers 57*a* and 57*b*. The adjusting layers 58*a* and 58*b* are provided to control the transport or diffusion of the oil from the inner oil holding layer 56*a* and 56*b* to the surface oil holding layers 57*a* and 57*b*.

In case of the oil coating roller 50*a* shown in FIG. 7A, the inner oil holding layer 56*a* is formed of Japanese paper (1), the adjusting layer 58*a* is formed of aromatic aramid fibers (2), and the surface oil holding layer 57*a* is formed of Japanese paper (2) selected from various materials shown in the table 1. In case of the oil coating roller 50*b* shown in FIG. 7B, the inner oil holding layer 56*b* is formed of aramid fibers and mineral fibers such as rock wool, the adjusting layer 58*b* is formed of aromatic aramid fibers (2), and the surface oil holding layer 57*b* is formed of Japanese paper (2).

The invention can be applied as long as the oil diffusing capacity and the oil holding capacity of the surface oil holding layer are less than the inner oil holding layer, and it is also possible to have a region where the oil diffusing capacity is smaller than the surface oil holding layer in the direction from the core bar toward the outer surface of the surface oil holding layer.

These embodiments are applied to the fixing apparatus 24 equipped with the fixing belt 34, which functions as the rotating member. However, needless to say, the present invention is applicable to a fixing apparatus equipped with a fixing roller as well by forming each layer (inner oil holding layer, adjusting layer, surface oil holding layer) with suitable materials having desirable oil diffusing and oil holding capacities. Moreover, the inner oil holding layer does not have to be formed directly over the outer surface of the core bar, but rather it can be formed on it via an intermediate layer.

As described above, these embodiments can reduce the oil coating amount (releasing agent supply amount) in the early period of the roller life to a level that does not cause problems such as oil stains, and increase the oil coating amount (releasing agent supply amount) in the final period of the roller life to a level that does not cause problems such as such as the offset phenomenon. As a consequence, it also prevents image noises.

It is obvious that this invention is not limited to the particular embodiments shown and described above but may be variously changed and modified without departing from the technical concept of this invention. Further, the entire disclosure of Japanese Patent Application No. 09-297171 filed on Oct. 29, 1997, including the specification, claims, drawings and summary are incorporated herein by reference in its entirety.

What is claimed is:

1. A releasing agent supplying apparatus for supplying releasing agent to a fixing device, the apparatus comprising:

a shaft, a first releasing agent holding layer provided around said shaft, and a second releasing agent holding layer provided outside of said first releasing agent holding layer, releasing agent holding capacity of said second releasing agent layer is less than that of said first releasing agent holding layer, wherein releasing agent diffusing capacity of said second releasing agent holding layer is less than that of said first releasing agent holding layer.

2. An apparatus according to claim 1, wherein said first releasing agent holding layer contains paper and said second releasing agent holding layer contains aramid fibers.

3. An apparatus according to claim 1, wherein the releasing agent holding capacity of said first releasing agent holding layer is 0.3–0.7 [g/cm$^3$].

4. An apparatus according to claim 1, wherein the releasing agent holding capacity of said second releasing agent holding layer is 0.3–0.7 g/cm$^3$ and the releasing agent diffusing capacity of said first releasing agent holding layer is higher than 17 mm/hr.

5. An apparatus according to claim 1, further comprising an adjusting layer disposed between said first releasing agent holding layer and said second releasing agent layer.

6. An apparatus according to claim 5, wherein said first releasing agent holding layer contains paper, said adjusting layer contains aramid fibers, and said second releasing agent holding layer contains paper.

7. An apparatus according to claim 5, wherein said first releasing agent holding layer contains mineral fibers and aramid fibers, said adjusting layer contains aramid fibers, and said second releasing agent holding layer contains paper.

8. A releasing agent supplying apparatus for supplying releasing agent to a fixing device, the apparatus comprising:

a shaft, and a releasing agent holding layer provided around said shaft, said releasing agent holding layer has a region with a small releasing agent holding capacity in a direction extending from said shaft toward an outer surface of said releasing agent holding layer, wherein releasing agent diffusing capacity of said releasing agent holding layer decreases in a direction extending from said shaft toward an outer surface of said releasing agent holding layer.

9. A fixing apparatus comprising:

a fixing device that contacts toner on a recording medium;

a pressuring device that fixes the toner by pressing said fixing device on the toner;

a supplying device that supplies releasing agent on a surface of said fixing device; and a releasing agent supplying apparatus for supplying the releasing agent to said supplying device, comprising a shaft, a first releasing agent holding layer provided around the shaft and a second releasing agent holding layer outside of the first releasing agent holding layer, releasing agent holding capacity of the second releasing agent layer, being less than that of the first releasing agent holding layer, wherein releasing agent diffusing capacity of the second releasing agent holding layer is less than that of the first releasing agent holding layer.

10. An apparatus according to claim 9, wherein the first releasing agent holding layer contains paper and the second releasing agent holding layer contains aramid fibers.

11. An apparatus according to claim 9, wherein the releasing agent holding capacity of the first releasing agent holding layer is 0.3–0.7 [g/cm$^3$].

12. An apparatus according to claim 9, wherein the releasing agent holding capacity of the second releasing agent holding layer is 0.3–0.7 g/cm$^3$ and the releasing agent diffusing capacity of the first releasing agent holding layer is higher than 17 mm/hr.

13. An apparatus according to claim 9, further comprising an adjusting layer disposed between the first releasing agent holding layer and the second releasing agent layer.

14. A fixing apparatus comprising:

a fixing device that contacts toner on a recording medium;

a pressuring device that fixes the toner by pressing said fixing device on the toner;

a supplying device that supplies releasing agent on a surface of said fixing device; and a releasing agent supplying apparatus for supplying the releasing agent to said supplying device, comprising a shaft and a releasing agent holding layer provided around the shaft, the releasing agent holding layer having a region with a small releasing agent holding capacity in a direction extending from the shaft toward an outer surface of the releasing agent holding layer, wherein releasing agent diffusing capacity of said second releasing agent holding layer is less than that of said first releasing agent holding layer.

* * * * *